United States Patent [19]

Kunczynski

[11] Patent Number: 4,744,306

[45] Date of Patent: May 17, 1988

[54] CONVEYOR SYSTEM AND METHOD OF OPERATION FOR AN AERIAL TRAMWAY OR THE LIKE

[76] Inventor: Jan K. Kunczynski, 2400 Arrowhead Dr., Carson City, Nev. 89701

[21] Appl. No.: 722,697

[22] Filed: Apr. 12, 1985

[51] Int. Cl.[4] ..... B61B 13/00

[52] U.S. Cl. ..... 104/168; 104/173.1

[58] Field of Search ..... 198/321, 324, 334, 792, 198/787, 465.4; 104/168, 173 ST, 173 R, 89, 173.2, 173.1

[56] References Cited

U.S. PATENT DOCUMENTS

| | | | |
|---|---|---|---|
| 2,905,101 | 9/1959 | Sinden | 198/787 |
| 3,596,607 | 8/1971 | Pomagalski | 104/168 |
| 3,662,691 | 5/1972 | Goirand | 104/173 |
| 3,735,710 | 5/1973 | Hickman | 104/168 |
| 3,759,188 | 9/1973 | Woods | 104/168 |
| 3,871,303 | 3/1975 | Woodling | 104/168 |
| 3,880,088 | 4/1975 | Grant | 104/168 |
| 4,050,385 | 9/1977 | Gurr et al. | 104/173 ST |
| 4,057,017 | 11/1977 | Michalon | 104/89 |
| 4,078,499 | 3/1978 | Girand | 198/334 |
| 4,403,552 | 9/1983 | Kunczynski . | |
| 4,503,778 | 3/1985 | Wilson | 104/28 |
| 4,508,205 | 4/1985 | Aulagner et al. | 198/334 |
| 4,530,287 | 7/1985 | Sticht | 104/168 |
| 4,563,955 | 1/1986 | Tarassoff | 104/168 |
| 4,564,100 | 1/1986 | Moon | 104/168 |

FOREIGN PATENT DOCUMENTS

| | | | |
|---|---|---|---|
| 125967 | 11/1984 | European Pat. Off. | 104/173 ST |
| 1505985 | 8/1969 | Fed. Rep. of Germany | 104/168 |
| 2060030 | 6/1972 | Fed. Rep. of Germany | 104/173 ST |
| 3213024 | 11/1982 | Fed. Rep. of Germany | 104/173 R |
| 2333684 | 7/1977 | France | 104/173 R |
| 2496029 | 6/1982 | France | 104/173 ST |

*Primary Examiner*—Robert J. Spar
*Assistant Examiner*—D. Glenn Dayoan
*Attorney, Agent, or Firm*—Flehr, Hohbach, Test, Albritton & Herbert

[57] ABSTRACT

A method and apparatus of spacing detachable passenger carrier units along the length of a moving haul rope in an aerial tramway system is disclosed. The apparatus includes a conveyor system which has a spacing section that is operated at a speed which is reduced by a speed factor determined by the geometry of the passenger carrier units and the geometry and operating parameters of the particular tramway line on which the units are to be spaced. Additionally, the speed of the spacing section is varied in accordance with the number of units which are selected to be spaced along the length of the line as compared to the maximum capacity of the tramway. Input of the selected number of units to a controller programmed with the particular tramway operating parameters and geometry will automatically slave the spacing section so as to discharge units to a launching system at an interval which insures even spacing. Adjustment of errors in spacing is also provided by eddy current drive motors operated immediately in advance of the spacing section at a speed somewhat greater than the speed in the spacing section so as to eliminate gaps between the passenger carrier units and insure that all the units are positioned in touching relation in the spacing section. A conveyor system for controlled, positive advancement of load carrier units along a support rail also is disclosed.

2 Claims, 4 Drawing Sheets

CONVEYOR SYSTEM AND METHOD OF OPERATION FOR AN AERIAL TRAMWAY OR THE LIKE

BACKGROUND OF THE INVENTION

In recent years there has been an increase in the installation of aerial tramway systems in which the passenger carrier units are selectively detachable and attachable to the tramway haul rope. Both gondola-based and chair-based aerial tramways are being installed in which the chair or gondola is provided with a haul rope gripping mechanism that can be opened and closed at the tramway terminals to allow the passenger carrier unit to be detached from the haul rope and slowed down for loading and unloading while the haul rope speed is maintained. Typical of the haul rope grip assemblies that enable detachment of the passenger carrier units is the grip assembly of my U.S. Pat. No. 4,403,552.

Prior to release of the gondola or chair from the haul rope, the passenger carrier unit is supported by a roller assembly carried by the gondola or chair hanger arm which roll on a guide rail extending immediately proximate the haul rope. Once the passenger carrier unit is detached from the haul rope, it usually will be decelerated at the terminal and then advanced at a relatively low speed along the rail through an unloading and loading zone. Thereafter the gondola or chair is accelerated on the guide rail to haul rope speed and attached to the haul rope on the fly. Attendants assist the tramway users in exiting and boarding the passenger carrier units at the unloading and loading zones while the units travel on the guide rail at a speed in the range of 20 to 80 feet per minute.

Aerial tramways with detachable passenger carrier units inherently have the problem of evenly spacing the detachable units along the length of the haul rope line. Prior aerial tramway systems have approached this problem by using distance based attachment systems. Each aerial tramway system will have a maximum permissible number of units which can be supported on the haul rope at any time. The maximum is often controlled by code in terms of a minimum time interval between passenger carrier units, typically a minimum of 9 seconds. For a maximum haul rope speed of 1000 feet per minute, for example, the minimum distance between chairs or gondolas permissible by a 9 second time interval is 150 feet. If a chair or gondola is attached to the haul rope at 150 foot intervals, the maximum number of passenger carrier units can be determined simply by dividing the overall length of the tramway haul rope by the minimum spacing distance.

Employing a distance-based uniform spacing system, however, is complicated by several factors. The maximum number of units which can be positioned on the haul rope is rarely an even number, and tramway operators often operate at less than maximum tramway capacity. An 8000 foot long lift, for example, would have 53.33 chairs or gondolas as a maximum number which can be attached to the haul hope on the uphill and the downhill sides of the haul rope, if the tram is operating at 1000 feet per minute with 9 second minimum intervals. The tramway operator may decide, for various reasons, that only 45 chairs or gondolas will be used instead of 53.33. To evenly space the passenger carrier units on each side of the rope, the gondola attachment system must attach a chair every 177.78 feet.

At least three distance-based gondola attachment systems can be found in the industry. Virtually all of the prior systems include a section of storage conveyor rail upon which detached units are slowly advanced, often by gravity, to an electric launching clutch which releases the units to the launching system. The launching system includes an accelerator plus a grip actuating mechanism to cause the grip to close around the moving haul rope once the chair or gondola reaches the haul rope velocity.

In the first system, a haul rope odometer measures the length of cable passing before it and releases the electric launching clutch periodically in accordance with the spacing desired between units. The launching clutch holds up units on the storage conveyor rail until sufficient cable has passed through the odometer, and then the clutch is released. If there are no units in the storage section, the odometer opens the clutch, and the next unit arriving at the clutch is free to be launched.

In a second system a sensor, such as a wand or arm, engages a portion of the passenger carrier unit, such as the hanger arm, and the sensor is positioned downstream of the electric clutch and the launching assembly. As the preceeding unit hanger arm moves past the downstream sensor, the electric clutch is signalled to allow release and launching of the next unit. This approach is satisfactory for a fixed spacing, but when the spacing between units is varied, the sensor needs to be repositioned or an adjustment made through a timing delay.

A third system which is found in the prior art is a storage conveyor in which the units are engaged, usually at their hanger arms, by forks or arms which are carried at predetermined fixed intervals along a drive chain. The drive chain advances the gondolas or chairs around the storage conveyor rail to the launching area in a fixed relationship with the rate of movement of the chain being slaved to the rate of movement of the haul rope. Thus, the chain may advance at a linear rate which is much less than the haul rope, but it is slaved or controlled so that when the haul rope speed slows down, the chain advance rate slows to maintain the same relative proportion between the two.

This fixed-distance spacing conveyor has been found to have several disadvantages. First, if a unit should arrive a little late and miss the space between the arms or forks which pick up the units, there will be a gap of one complete unit along the haul rope. There will be a plus or minus 100% spacing error. This problem tends to perpetuate itself on subsequent cycles of the units. Additionally, if the tramway operator wishes to employ something less than the maximum capacity of the fixed-distance spacing conveyor, considerable problems are encountered. If it is desired to send out half the maximum number of chairs, it is a simple matter to simply remove every other chair from the fixed-distance spacing conveyor. Similarly, even spacing can be achieved for other percentages, for example 33.33%, but one cannot simply remove chairs from a fixed-distance spacing conveyor and get an even spacing along the haul rope for 80% of maximum capacity, for example.

Even when chairs are removed from the fixed-distance spacing conveyor to reduce the capacity below maximum, the result is there are fewer chairs at each of the terminals in the spacing conveyor. This in turn means that the time to load and unload is reduced, making the loading and unloading procedure more hazardous. Finally, prior art fixed-distance spacing conveyors with intervals defined by arms on a drive chain inherently require that the passenger carrier units be driven at the same speed over the entire length of the drive chain. It is not possible, therefore, to accelerate a unit and then decelerate or stop it to enable loading and unloading without accelerating, decelerating and stopping all of the units.

OBJECTS AND SUMMARY OF THE INVENTION

A. Objects of the Invention

Accordingly, it is an object of the present invention to provide a method and apparatus for spacing attachable and detachable passenger carrier units along the length of a moving haul rope in an aerial tramway or the like in which even spacing can be more easily and reproducibly accomplished.

It is another object of the present invention to provide a spacing conveyor for an aerial tramway or the like which is formed to discharge passenger carrier units onto attachment apparatus at a rate which will insure uniform spacing of the passenger carrier units along the length of the haul rope.

A further object of the present invention is to provide a method for spacing a selected number, up to a maximum number, of passenger carrier units along the length of a haul rope in an aerial tramway system which is effective notwithstanding variations in the speed of movement of the haul rope.

Still another object of the present invention is to provide a method for spacing detachable passenger carrier units along the length of a haul rope in an aerial tramway which can be easily adjusted to accommodate changes in the number of units to be spaced along the haul rope.

Another object of the present invention is to provide a method and apparatus for attaching passenger carrier units to the haul rope of an aerial tramway which is simple to operate, will accommodate a wide range of operating conditions, can be added to existing tramway systems, is durable and reliable in its operation, is formed to adjust out uneven spacing, and can be operated by relatively inexperienced personnel.

A further object of the present invention is to provide a load carrying conveying system and method of operation which will permit independent acceleration and deceleration of load carrying units upon a support rail which can include curved sections while still positively controlling unit velocity.

The apparatus and method of the present invention have other objects and features of advantage which will become more apparent from and are set forth in more detail in the following description of the preferred embodiment and the accompanying drawings.

B. Summary of the Invention

The method of moving load carrier units along the length of a conveyor support rail and of spacing the units evenly along a moving haul rope in an aerial tramway comprises, briefly, the steps of selecting the number of units to be spaced along the haul rope up to a maximum number, attaching the units to the haul rope while in motion by attachment means slaved to the speed of the haul rope, and discharging the units to the attachment means from a spacing section of a conveyor system in which the unit velocity is positively controlled. The spacing section of the conveyor sysem is driven to discharge units to the attachment means at a speed slaved to the speed of advancement of the haul rope multiplied by a spacing factor proportional to the selected number of units divided by the maximum number of units. Additionally, a predetermined known spacing of units in the spacing section of the conveyor is established by controlling conveyor velocity to produce contact of units in the spacing section. After contact is established between units they are discharged at a velocity determined by the number of units to be spaced along the haul rope.

Most preferably the conveyor system, including the spacing section, is further slaved to the haul rope by a speed factor in which the haul rope speed is divided by the speed factor. The speed factor is equal to or greater than the haul rope length divided by the product of the minimum spacing of units on the spacing conveyor times the maximum number of units permitted by the capacity of the haul rope.

The spacing apparatus of the present invention comprises, briefly, support rail means formed to support the passenger carrier units while detached from the haul rope, drive means formed to advance the units while on the support rail means to attachment apparatus formed to attach the units to the haul rope, and control means coupled to the drive means and formed for input as to a selected number of units to be positioned along a haul rope, the control means being further formed to control the speed of discharge of the units from a spacing section of the conveyor to the attachment means by slaving the speed of discharge of the units on the support means to the speed of movement of the haul rope times a spacing factor directly proportional to the selected number of units and inversely propotional to the maximum number of units permissible by the capacity of the aerial tramway. The control means slaves the speed of discharge of the detached units from the spacing section to the remainder of the conveyor by the relationship $V_c=(V_R/a)k$, where $V_c$ equals the speed of advancement of the detached units, $V_R$ equals the speed of movement of the haul rope, k equals the spacing factor, which equals the number of units selected divided by the maximum number of units permissible, and a equals a speed factor, which is at least equal to or greater than the length of the haul rope divided by the product of the maximum number of units times the minimum spacing between units on the conveyor.

The load carrying conveyor system includes a rail extending along the length of a course, a plurality of lightweight load carrying units movably mounted to the rail and having a drive shoe secured thereto, and unit propelling means positioned along the rail to engage the drive shoe and propel the units. The improvement in the system is comprised, briefly, of the propelling means being provided by a plurality of drive members in side-by-side relation along the rail to drivingly engage the drive shoe over substantially the entire length of the course. Some of the adjacent drive members are operated at different drive speeds to enable acceleration and deceleration of units, and the drive shoe and drive members are formed to permit relative slippage to accommodate differences in drive speeds and to effect independent smooth acceleration and deceleration of units by the individual drive member.

DESCRIPTION OF THE PREFERRED EMBODIMENT

The spacing conveyor and method of the present invention is particularly well suited for use in connection with an aerial tramway of the type in which there is an endless loop of haul rope (cable) supported by a plurality of rotatable sheaves mounted to spaced apart support towers. Each end of the haul rope loop is provided with a station or terminal at which passengers board passenger carrier units. Intermediate terminals for boarding and unloading also can be provided. Usually, such passenger carrier units take the form of gondola cabins or chairs, but it will be understood that the conveyor system of the present invention also can be used in connection with skilifts in which the skier is towed up the mountain while his skis are in contact with the snow. Similarly, other personnel, product or load conveying apparatus in which there are individual load carrying units which must be conveyed along a course, accelerated, decelerated and stopped while still positively controlled can advantageously make use of the conveyor system and method of the present invention. As used herein, "tramway" and "aerial tramway" shall include all such load carrying conveyor systems.

Figure 1:
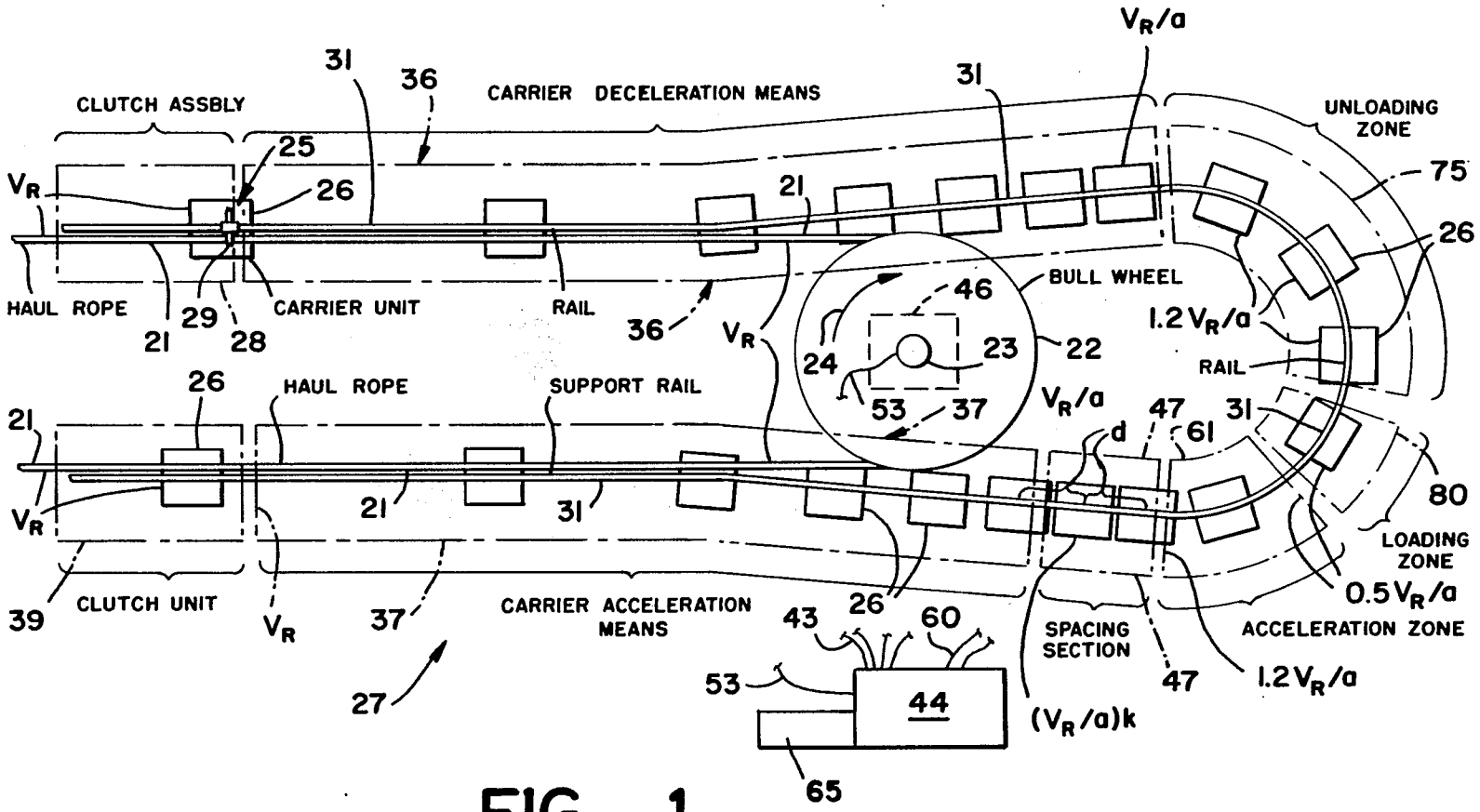
FIG. 1 is a top plan schematic view of an upper or drive terminal of an aerial tramway system showing a conveyor system constructed in accordance with the present invention.

As seen in FIG. 1, haul rope 21 is carried and driven by bullwheel 22 which rotates about a drive shaft 23 in the direction of arrow 24. Detachably mounted to haul rope 21 are a plurality of load or passenger carrier units 26, which are schematically illustrated by rectangles representing gondola cabins.

In order to detach carrier units 26 from haul rope 21, the tramway terminal, which is here illustrated as the driving or upper terminal and is generally designated 27, usually will include a clutch assembly 28, which is formed to engage the haul rope gripping mechanism of the passenger carrier unit and release the same from the haul rope. Such clutch assemblies as well known in the art and can including converging rails, or converging wheel assemblies or converging wheel driven belts (as is shown in my U.S. Pat. No. 4,403,552).

Figure 4:
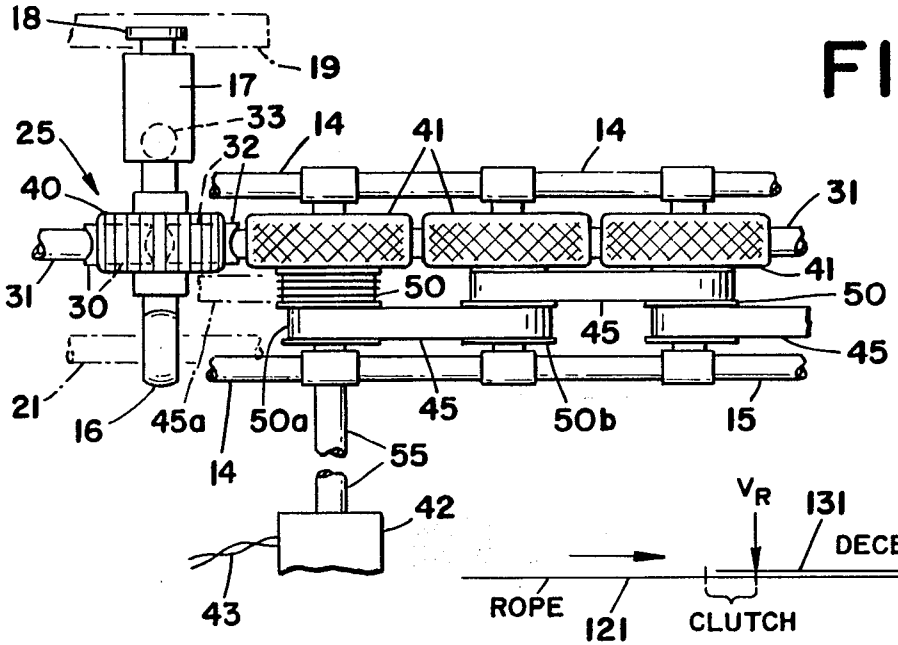
FIG. 4 is an enlarged, fragmentary, top plan view of a section of the conveyor drive assembly shown in FIG. 3 bounded by line 4—4 and showing a carrier unit hanger arm.

As best may be seen in FIG. 4, the passenger carrier units are provided with a support assembly 25 which both grips haul rope 21 and supports the detached units on a guide rail 31. Assembly 25 includes a haul rope gripping jaw 16 and grip actuator portion 17 which is progressively depressed or engaged by clutch 28. In the area of clutch 28, an auxilliary rail 19 is provided so that roller element 18, bearing upon rail 19, and sheaves 30 and 32, bearing upon rail 31, will support assembly 25 against rotation as grip actuator 17 is depressed by clutch 28 and jaws 16 are opened.

Assembly 25 is coupled to the cabin, chair or load support structure of unit 26 through a hanger arm 33 which depends downwardly from rail 31 and rope 21. Upon release of grip 16 by clutch 28, the gondola is rollingly suspended from rail 31 by sheaves 30 and 32. Since clutching or releasing of unit 26 from the haul rope occurs gradually and the gondola cabin and passengers have inertia, gondola 26 will travel at substantially the same velocity, $V_R$, as the haul rope over the length of clutch assembly unit 28. As the cabin reaches the end of clutch assembly 28, however, it is traveling on track 31 free of haul rope 21. Grip 16 can be of the kind in which the grip remains open after passing through the clutch assembly, or the clutch and rail can gradually separate vertically so as to raise grip 17 up above haul rope 21 a sufficient distance so that the grip can be closed at the end of the clutch assembly without regrasping the haul rope.

The velocity of an aerial tramway haul rope is desirably relatively high (e.g., twice the velocity which a fixed-grip tramway would be operated) in order to provide the maximum up-hill capacity for the tramway. One of the advantages of the detachable passenger carrier unit system is that the haul rope speed can be relatively high and yet the carrier units can be decelerated for loading and unloading and thereafter accelerated back to the haul rope speed. Thus, terminal 27 further includes carrier unit deceleration means, generally designated 36, and a carrier unit acceleration means, generally designated 37. Acceleration and deceleration units similarly are known in the broad sense in the industry and typically include apparatus which slows the passenger carrier unit on rail 31 so as to apply a controlled deceleration to the unit to reach a speed suitable for loading and unloading of the passengers from the carriers 26.

Thus, the speed of cabin 26 on rail 31, as it exits deceleration unit 36, will be the velocity of the haul rope, $V_R$, divided by some speed factor constant, a, namely $V_R/a$. As will be discussed in detail below, speed factor a is selected to accomplish two goals, namely, to reduce the unit speed for loading and unloading, and to establish a spacing along the rail which can be used to space the units evenly along rope 21. Acceleration unit 37 essentially works in reverse and accelerates the gondola cabins from a relatively low speed up to approximately the velocity of haul rope 21, at which point a second clutch assembly 39 actuates the gripping mechanism causing grip 16 to grip the haul rope 21 on the fly.

In the gondola system of the present invention it is an important feature of the system that load carrier units 26 are positively controlled over the entire length of rail 31 when the are detached from rope 21. This is accomplished by engagement with a portion of units 26 by a plurality of drive members which are in side-by-side relation over substantially the entire length of rail 31. Moreover, positive control of the advancement of units 26 along rail 31 is entirely speed-based, that is, all of the propelling drive members are slaved to the speed of advancement of haul rope 21. While the drive members operate at different speeds to accelerate, decelerate or maintain the velocity of units 26, these speeds are proportionately reduced if, for example, the haul rope speed is reduced.

A form of positive driving control of units 26 on rail 31 is shown in FIG. 4. Drive wheels 41 are mounted to framework members 14 and 15 and positioned in spaced aligned relation over rail 31. The spacing vertically with respect to rail 31 is sufficient to receive assembly 25 therebetween so that wheels 41 frictionally engage a drive shoe 40 provided on carrier unit assembly 25 so as to propel carrier unit 26 along rail 31. Along straight sections of rail 31, such as decelerator 36 and accelerator 37, it is preferable to power drive wheels 41 by drive train means including a plurality of V-belts 45 mounted to pulleys 50 and powered through drive shafts 55 from drive motors 42.

Figure 3:
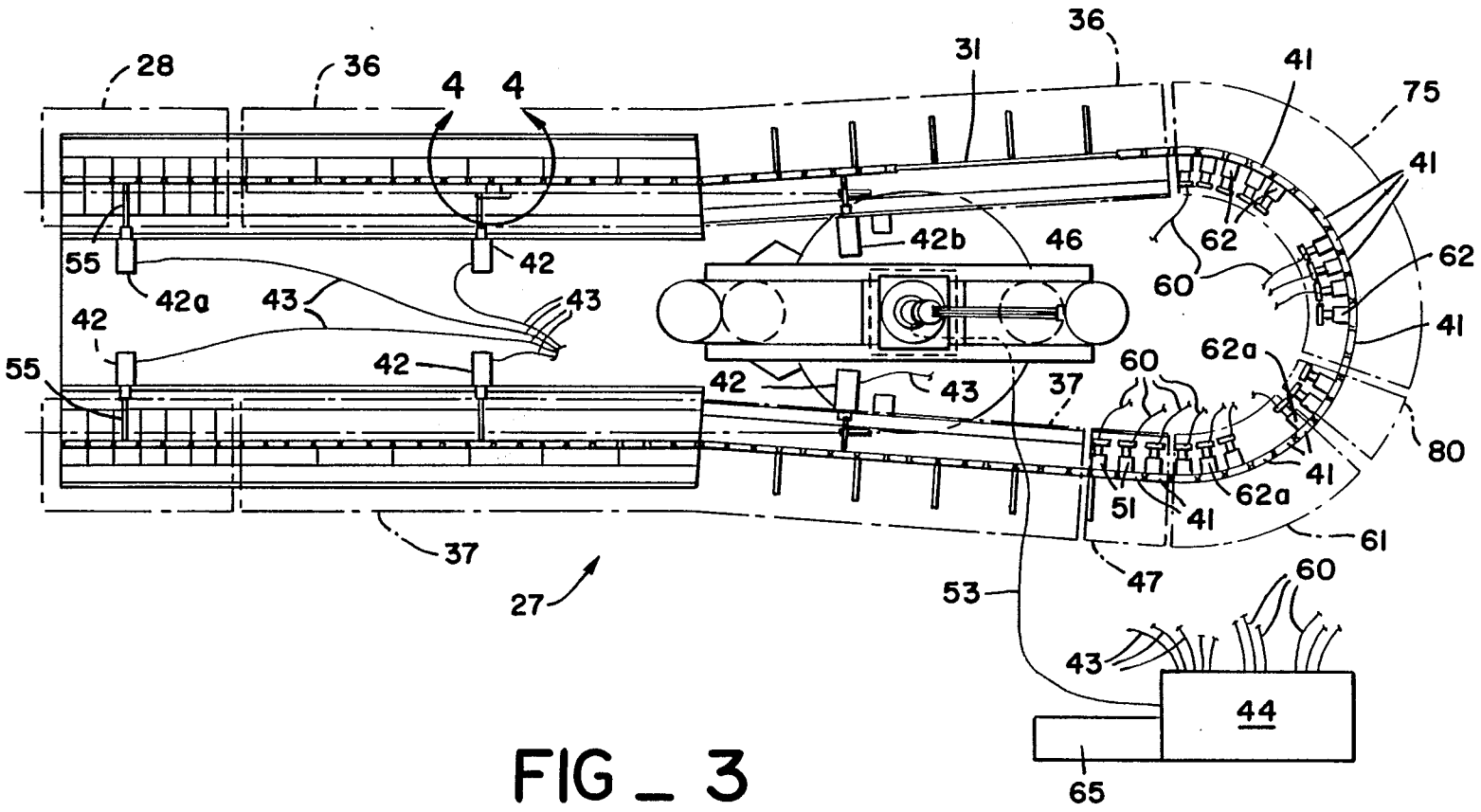
FIG. 3 is a top plan view of an upper terminal corresponding to the terminal schematically shown in FIG. 1.

The conveyor system of the present invention features the use of a common drive train coupling together a plurality of motors. Thus, drive motors 42 are positioned periodically along rail 31, and each motor is coupled by belts 45 to drive a set of wheels 41. Additionally, the sets of wheels on straight sections of rail 31 are coupled together, for example by belt 45*a* (FIG. 4), which extends back into the set of wheels driven by motor 42*a* (FIG. 3). The coupling of drive wheels 41 to multiple motors 42 by a common drive train provides conveyor system redundancy. Failure of motor 42 will still result in operation of drive wheels 41 in the section or set of wheels nominally driven by motor 42, since both motors 42*a* and 42*b* will be coupled by drive belts to drive the wheels therebetween.

Drive shoe 40 is advanced or propelled from one drive wheel 41 to the next and during process will be drivingly engaged by both adjacent drive wheels for a short distance. Since it is an important feature of the present invention that carrier units 26 be accelerated and deceleraed, shoe 40 and wheels 41 must accommodate differences in the speed of driving of adjacent wheels. This is accomplished by forming wheels 41 as rubber tires, preferably foam filled, which drive a metal drive shoe 40. Relative slippage between drive wheels 41 and shoe 40 is permitted, particularly as the arcuate surface of the wheels engage and disengage the shoe. It has been found that as shoe 40 moves from a position at which it is engaged only by one wheel 41 to a position at which it is engaged by two wheels, the second drive wheel initially slips with respect to shoe 40. As contact with the second or downstream drive wheel increases, it begins to control motion and the first or upstream wheel begins to slip. Such relative slippage between wheels 41 and shoe 40 as the carrier unit is advanced along rail 31 produces a relatively smooth and step-free or shock-free acceleration or deceleration of units 26.

It should be noted that the inertia of cabins 26 and their suspension by means of pivotally connected hanger arm 33 (which is common practice in the industry) will result in swinging of the gondola cabin in the fore-and-aft directions along the rail in areas of acceleration or deceleration, but such swinging can be minimized by an energy absorbing hanger arm connection and by driving wheels 41 along rail 31 at speeds selected to tend to cancel cabin swing. The constant deceleration and acceleration profiles shown in FIG. 2, for example, could be replaced by a sinusoidal profile having a period selected to reduce cabin swing.

As best may be seen in FIG. 4, V-belts 45 are coupled to sheaves 50 having diameters producing the desired deceleration or acceleration as units 26 pass through the decelerator and accelerator. In decelerator 36, for example, outer sheave portion 50*a* has a smaller diameter than outer sheave portion 50*b* so as to cause the adjacent, downstream drive wheel to be operated at a slower speed than the wheel driven by shaft 55. In the accelerator the sheave sizes are reversed to produce acceleration of the passenger carrier units.

Drive motors 42 are electrically connected through lines 43 to speed control means 44, which is formed to slave the speed of drive motors 42 to the speed of the haul rope, as determined, e.g., by a tachometer (not shown) mounted to sense the speed of rotation of drive shaft 23. When haul rope motor 46 is slowed for any reason, decelerator 36 and accelerator 37 similarly follow the haul rope speed, and units 26 are decelerated to and accelerated from a lower speed by controller 44 based upon feedback through connection 53 from the drive shaft tachometer.

Since V-belts 45 are not well suited for transmitting power around turns, the conveyor system of the present invention preferably employs a plurality of individual drive motors 62 having drive wheels 41 mounted directly thereto for driving of shoe 40 on the conveyor turns. Each of individual motors 62 is again coupled by connections 60 to controller 44 so that the speed of operation of each motor is slaved to the speed of advancement of haul rope 21.

In addition to positively controlling the advancement of detached units 26 along rail 31, the conveyor system of the present invention includes a spacing section 47 that establishes uniform spacing of units on the conveyor and, as a result threof, on the haul rope. Spacing section 47 accomplishes the task of establishing uniform spacing by discharging units to accelerator 37 at a speed which is adjusted to be proportional to the number of units to be spaced along rope 21, and by causing units 2 to be spaced along rail 31 in a predetermined known relationship.

The prior art aerial tramway systems have included conveyor systems having an accumulating section along rail 31 which essentially extends between carrier deceleration means 36 and acceleration means 37. A plurality of carrier units 26 are typically accumulated and progressively advanced along this storage section of the rail conveyor until they are discharged onto acceleration means 37. In prior art electric launching clutch systems, a haul rope odometer or downstream sensor is used to launch units onto the accelerator, and in fixed-distance spacing conveyors, the conveyor spacing forks along a drive chain establish the spacing interval.

In the conveyor system of the present invention, passenger carrier units 26 are not captured or engaged by spacing forks or arms in spacing section 47, but instead the physical size of unit 26 (or support assembly 25) along rail 31 is used to establish a uniform spacing. Units 26 are, therefore, brought into contact with each other in section 47, so that a precise relationship between units along rail 31 is automatically established. Once in contact in spacing section 47 the units are advanced at a speed which can be adjusted in proportion to the number of units to be used on the particular day so as to discharge units to accelerator 37 in an evenly spaced intervals of predetermined length. Accelerator 37, in turn, brings the units up to rope speed, and during the acceleration process, separates the units to the desired distance along the rope.

While slaving the speed of discharge from spacing section 47 to the speed of haul rope 21 is not new per se, in the aerial tramway system of the present invention the speed of discharge is further slaved by a spacing factor, k, which results in many of the advantages of the system of the present invention. As indicated, herein there will be a maximum number of passenger carrier units, N, which can be evenly spaced along the length, L, of the haul rope. This maximum number will be determined by the speed of the haul rope, $V_R$, and the minimum time interval, t, between passenger carrier units, usually determined by code (e.g., the code of The American National Standards Institute). While there is a maximum number of units that can be evenly spaced along the haul rope, it is more frequently the case that the aerial tramway will not be operated at a maximum capacity. There will be, therefore, a selected number of passenger carrier units, n, which will varied periodically. Control means 44 includes input means 65 in which the operator can input the desired or selected number of units, n, to be spaced along the haul rope up to the maximum number of units, N, permitted by the capacity of the lift. Once the selected number has been input, control unit 44 slaves the speed of advancement of the units in spacing section 47 by spacing factor k, which is directly proportional to the number of units selected and is inversely proportional to the maximum number of units permitted by the capacity of the tramway.

In the spacing section of the conveyor system of the present invention, therefore, the speed of the units discharging from the spacing section, $V_c$, is controlled by controller 44 after input by the operator in accordance with the following relationship:

$$V_c=(V_R/a)k, \text{ where } k=n/N$$

or $$V_c=V_R n/aN$$

The constant a is the speed factor used to reduce the speed of the units to a level making boarding while the detached units are moving on rail 31 possible and to insure contact between units in spacing section 47. Usually the speed factor a should be large enough so that the rate of movement in unloading zone 75 and loading zone 80 at maximum speed is not greater than about 100 feet per minute and is preferably in the range of about 20 to about 60 feet per minute.

Speed factor, a, cannot be too small or else not only will the velocity of units in the unloading and loading zones be undesirably large, but it will not be possible to discharge units from the spacing section 47 to accelerator means 37 at a rate which is slow enough to achieve the minimum spacing permitted by the Code for minimum time interval between units. Accordingly, spacing factor, a, must be greater than or equal to the length of the haul rope divided by the product of the minimum distance, d, between units possible in spacing section 47 times the maximum number of units, N, which can be evenly spaced along the length of the haul rope, L, as determined by the tramway capacity.

More particularly:

$$a \geqq L/(dN)$$

Since acceleration means 37 is slaved to the haul rope speed, spacing section 47 cannot discharge units 26 onto the accelerator any faster than the minimum time interval permissible between units attached to the haul rope. The maximum conveyor speed permissible is:

$$V_c=d/t$$

and the relationship at maximum capacity between the haul rope speed and the conveyor speed is:

$$V_c=V_R/a.$$

Therefore, $$d/t=V_R/a.$$

$$a=V_R t/d.$$

Since the rope velocity, $V_R$, also is equal to the total rope length, L, divided by the product of the maximum number of units and the minimun time, $$V_R=L/(Nt)$$

then, $$a=L/(Nt)\times t/d$$

$$a=L/(Nd).$$

Once the minimum spacing, d, in section 47 is known, the length of the haul rope and maximum number of units permissible on the rope allows the speed factor a to be set to insure that the spacing section of the conveyor is not discharging units too fast to the accelerator.

Since it is desirable to be able to reach the minimum spacing on the haul rope (maximum capacity), it is further preferable that the speed factor, a, be about equal to L/(Nd) so that when k equals 1 in the formula:

$$V_c=(V_R/a)k$$

substantially maximum capacity is achieved.

The effect of increasing the speed factor a beyond the minimum value would be to reduce the maximum capacity of the tramway by the ratio of the minimum speed constant divided by the selected speed constant.

In any aerial tramway system having detachable carrier units it is possible for errors to occur in the location at which the units are attached to the haul rope. Mechanical grip mechanisms, for example, can slip somewhat before gripping of the rope is completed. Even though the conveyor system attempts to positively control the advancement of units along rail 31, some errors in unit position will occur. It is a further important feature of the present invention, therefore, to provide means for adjustment of the spacing of passenger carrier units 26 along rail 31 to insure contact of units in spacing section 47 so that such errors in attachment are not perpetuated in subsequent cycles of the units through the system.

In the apparatus of the present invention such error adjustment and contact in section 47 is provided by an adjustment or acceleration zone 61, here shown mounted between loading zone 80 and spacing section 47. Drive means **62*a* of adjustment assembly 61 are slaved to the speed of movement of the haul rope at a speed which is in excess of the speed of advancement of the passenger carrier units in the spacing section 47. Moreover, drive means 62*a* are further formed so that the forward driving force of motors 62*a* will be overcome if the passenger carrier units are too close together. More particularly, motors 62*a* in adjustment means 61 are preferably eddy current electric motors which are slaved through controller 44 by lines 60 to the speed of advancement of haul rope 21. Adjustment or acceleration zone 61, therefore, drives passenger carrier units 26 along track 31 at a rate which is greater than the rate at which they are conveyed along track 31 in spacing section 47. As the units are forced into contact with each other and accordingly cannot be advanced further in adjustment zone 61, eddy current motors 62a allow sufficient slippage so that units moving along adjustment zone 61 essentially have their velocity reduced to the same velocity as in spacing section 47. In the event that there are gaps induced in the system, however, acceleration zone 61 causes the units catch up to the units in spacing section 47** to thereby eliminate the gaps.

The velocity in zone 61 can be selected to be a velocity somewhat greater than the maximum velocity in spacing section 47, for example 10% or 20% greater than the maximum velocity. Since the maximum velocity in spacing section 47 occurs when k equals one, the velocity in zone 61 can conveniently be 1.2 $V_R/a$.

Figure 2:
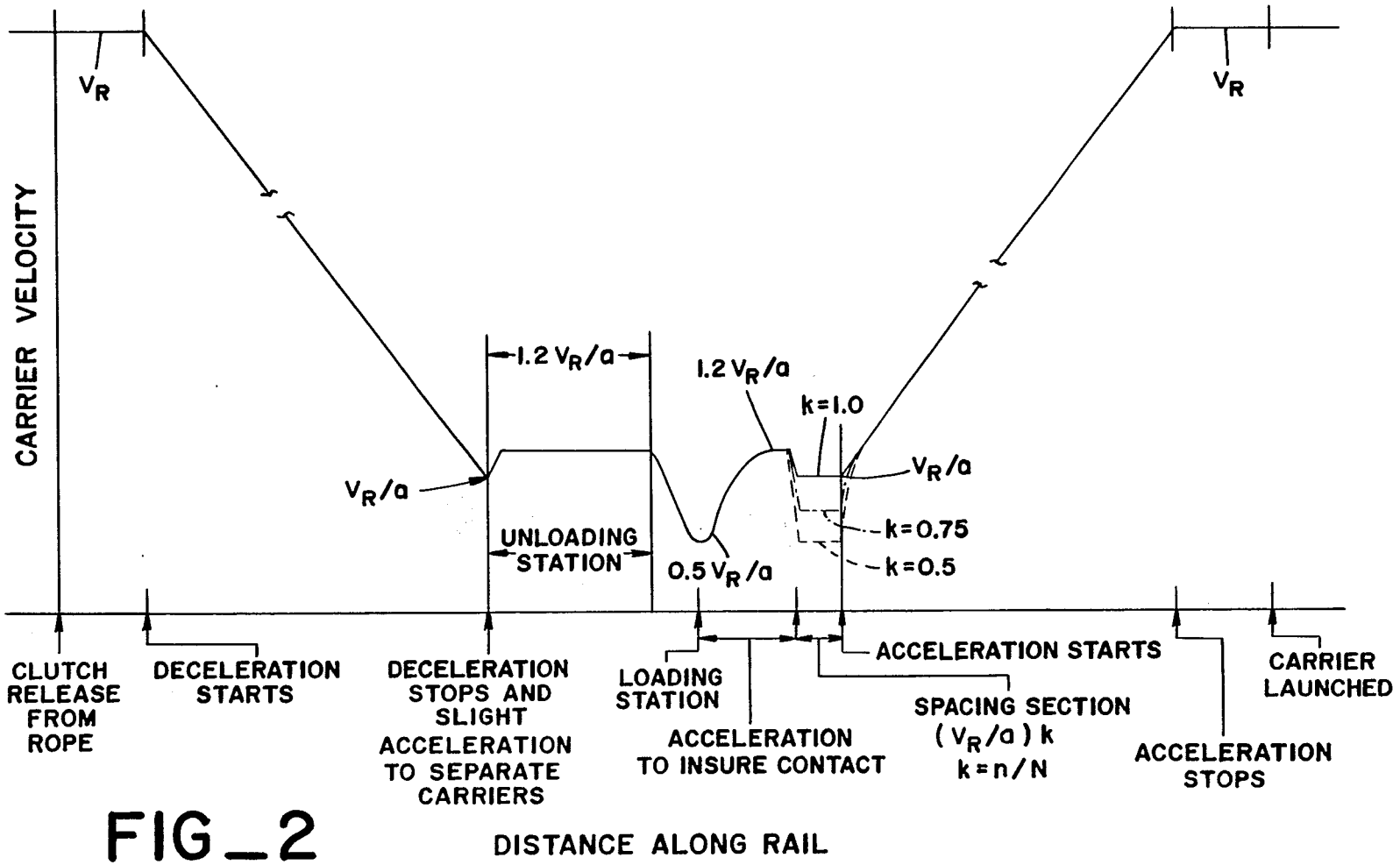
FIG. 2 is a graphic representation of the velocity of a passenger carrier unit versus distance as the unit travels on a conveyor system of the present invention around the terminal of FIG. 1.

FIGS. 1 and 2 illustrate a gondola type of aerial tramway terminal 27 in which the unloading and loading zones are in advance of spacing section 47. Moreover, both zones 75 and 80 are located on a curved portion of rail 31. In order to prevent contact between gondola cabins 26 on curved portions of rail 31, it is preferable to slightly accelerate the units in unloading zone 75 over the final velocity, $V_R/a$, at which they exit from decelerator 36. Contact of cabins on the curved section tends to result in outward displacement of the cabins, which is considerable.

As will be apparent from the numerical example, the exit velocity $V_R/a$ from decelerator 36 is well below the 70 to 100 foot per minute level commonly in use in the industry today. Accordingly, increasing that velocity by 20 percent to insure separation of the cabins on the turns still yields a velocity in unloading zone 75 which is very acceptable and below industry standards.

In order to facilitate the loading process it is also possible to rapidly slow the cabins in loading zone 80 to a much slower speed, e.g., 0.5 $V_R/a$, or even to momentarily stop the cabins. Such slowing or stopping can only be tolerated as long as the next cabin does not catch up to or contact the slowed or stopped cabin. This depends upon the spacing between cabins as they leave the unloading zone and the rate of deceleration in loading zone 80. As will be appreciated, cabins 26 could be further accelerated at the end of unloading zone 75 to increase separation, which will permit greater deceleration in loading zone 80. Additionally, acceleration zone 61 must accelerate the loaded cabin away from the next cabin before the unloaded cabin reaches the loading station.

Thus, the velocity profile between the decelerator and the accelerator preferably is: acceleration in zone 75 to produce separation and yet a speed permitting unloading, deceleration in zone 80 to ease loading without contact, acceleration in zone 61 to empty the loading zone and cause units to contact each other in spacing section 47, followed by a controlled velocity discharge from the spacing section 47 to establish even unit spacing.

OPERATION AND EXAMPLE

Operation of the method and apparatus of the present invention can be better understood by reference to a specific example and to FIG. 2 in which a velocity versus distance profile along the tramway terminal is shown.

The following operating parameters and physical dimensions will be assumed for the present example:

1. A maximum haul rope velocity, $V_R$, equal to 1000 feet per minute.
2. A haul rope length, L, of 10,000 feet between the lower and upper terminals. The actual length would be twice the distance assumed, but each terminal preferably is provided with conveyor apparatus in accordance with the present invention.
3. A minimum spacing interval, t, of 9 seconds.
4. A minimum distance, d, between contacting gondolas in spacing section 47 of 5.6 feet, which is essentially the length of a typical gondola cabin along track 31.

The maximum number of units, N, which can be attached between the upper and lower terminals, therefore, is:

$$L/N = V_R t$$

$$N = L/(V_R t) = 10{,}000/(1000 \times 9/60)$$

$$N = 66.67 \text{ units}$$

The smallest value which the speed factor, a, can be is:

$$a \geqq L/(dN) = 10{,}000/(5.6 \times 66.67)$$

$$a \geqq 26.8$$

Finally, it will be assumed that the number of units selected by the system operator to space evenly along the haul rope is variously as follows:

a. 66.67 (100% of maximum), and
b. 50 (75% of maximum), and
c. 33 (about 50% of maximum).

Referring now to FIG. 2 and moving from left to right as the passenger carrier units enter terminal 27, the incoming velocity of the gondolas will be seen to be the same as the haul rope velocity, namely, 1000 ft. per minute. Clutch assembly 28 will release grip 16 from haul rope 21, but the gondola will be supported on track 31 and traveling at the haul rope velocity $V_R$ until the unit reaches decelerator 36. Decelerator 36 will then decelerate the gondola velocity to a discharge velocity of $V_R/a$. Since a is equal to 26.8, the velocity of units discharged from decelerator 36 will be 37.3 ft. per minute. Since the decelerator is also slaved through controller 44 to the haul rope speed. Slowing of the haul rope will commensurately reduce the speed at which units are discharged from decelerator 36. A haul rope speed of 500 ft. per minute would, therefore, result in discharge of units from the decelerator at ½ of the above set forth velocity.

At the exit end of decelerator 36 the gondola cabins essentially will be in contact with each other if the number of units on the line is selected to equal the maximum capacity. If the selected number, n, is less than the maximum number N, there will be some spacing between units as they reach the end of decelerator 36.

In order to insure separation around the curved end portion of rail 31, units are accelerated slightly, e.g., by 20% in unloading zone 75. This is shown in FIG. 2 by a sloped line followed by constant velocity. For the example set forth, the velocity in loading zone 75 would be 44.8 feet per minute, which is well below the 70 to 80 foot per minute rate employed in unloading zones on other gondola systems. Since decelerator 36 discharges units to unloading zone 75 at 37.3 feet per minute, there will be a velocity difference between the discharge velocity and the unloading zone velocity that must be accomodated by slipping between adjacent drive wheels 41. The system and the passengers will easily accomodate the 7.5 foot per minute velocity difference between the decelerator and the unloading zone velocities. Exiting prior art gondola systems have even included rapid acceleration to produce velocity changes of 75 feet per minute over very short distances.

With gondolas 26 separated and traveling at 44.8 feet per minute, passengers exit the gondolas with the aid of lift attendants, who unload skis as well as assist in the opening of gondola doors. The gondolas are then slowed to one half their speed or 22.4 feet per minute in loading zone 80 and loaded with passengers, again with the assistance of lift attendants.

In section 61 the gondolas are accelerated back up to 44.8 feet per minute so that they will gradually come into contact with each other as the cabins enter spacing section 47. The acceleration section 61 causes cabins to be advanced to spacing section 47 faster than they are discharged to accelerator 37.

In spacing section 47 the speed of advancement and discharge will be determined by the number of gondolas which the tramway operator selects to use. In the example in which 100% of capacity is employed, $k=1.0$ and the velocity will be 37.3 feet per minute. For $k=0.75$ units will be advanced at 28 feet per minute, and for $k=0.5$ units will be advanced at 18.7 feet per minute. All these values are well below adjustment zone 61 velocity of 44.8 feet per minute, but the deceleration produced by contact with the preceding cabin is still very acceptable and far less than the accelerations already found in prior art gondola systems.

With units 26 in contact with each other in section 47, they are launched to accelerator 37 at a speed which produces even spacing for the selected number, n, of units 26. Accelerator 37 is formed to accelerated units from 37.3 feet per minute to 1000 feet per minute, the rope speed.

If desired, loading zone 75, unloading zone 80, adjustment or accelerator zone 61, the exit velocity of the decelerator 36, and entrance velocity of the accelerator 37 can all be operated at speeds which are multiplied by spacing factor k. This has the advantageous result that selecting a reduced number of units to run on the tramway merely slows the operation of the conveyor system between the decelerator and accelerator without reducing the number of units available for unloading and loading at the terminal. If, for example, 40 gondolas are to be spaced on line instead of 50, the operator must remove 10 gondolas from the line to storage, but each terminal will still be filled with gondolas. Adjustment of spacing is not accomplished in such a system at the expense of removing passenger carrier units from the terminals.

The method of spacing detachable passenger carrier units along the length of a moving haul rope of the present invention, therefore, is comprised of selecting the number of units to be spaced along the haul rope up to a maximum number of units. Having decided the number of units to be employed, input means 65 will be input with this selection. Controller 44 will adjust the motor speeds on the spacing section 47 so as to control the speed of discharge of units 26 with respect to the speed of movement of the haul rope by a spacing factor, k, proportional to the number of units selected divided by the maximum number of units. Additionally, the geometry of the units and more particularly the minimum spacing distance, d, between units on the spacing conveyor, is employed to automatically establish a fixed distance without the need of spacing forks or arms.

Figure 5:
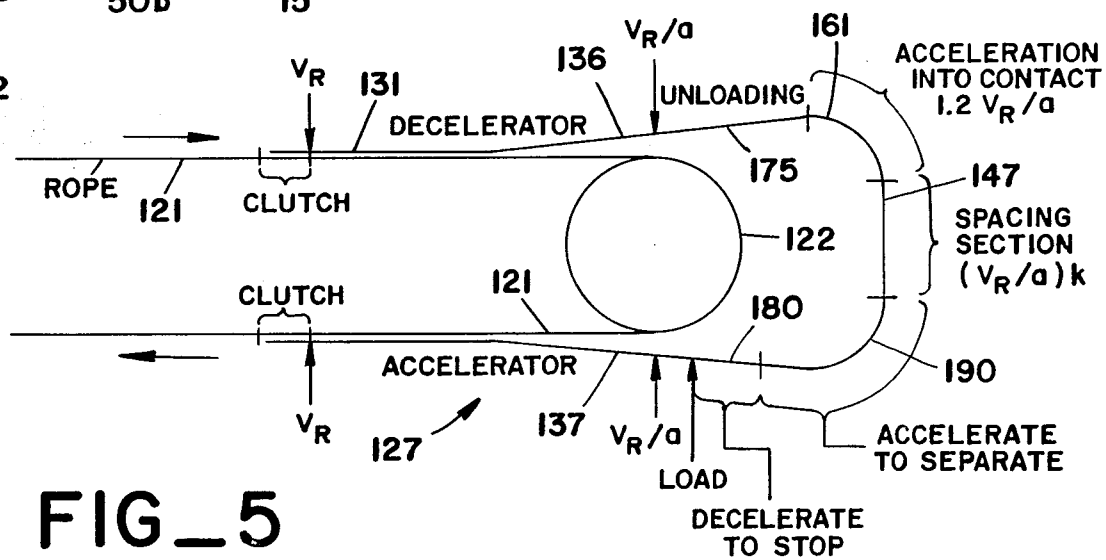
FIG. 5 is a top plan schematic view, in reduced scale of an alternative embodiment of the conveyor system of FIG. 1.

In FIG. 5 an aerial tramway system designed for chairs is shown. Tramway terminal 127 includes a guide rail 131 mounted proximate haul rope 121 and bull wheel 122. In the tramway of FIG. 5, passengers are unloaded in zone 175 immediately after decelerator 136. Acceleration zone 161 accelerates the units into contact along a straight rail section immediately prior to spacing section 147 while the chairs are empty. Thus, contact between chairs and/or the support assemblies along track 131 is not a problem.

After spacing and discharge from spacing section 147, the chairs can be rapidly accelerated in zone 190 to separate them and then stopped or slowed in zone 180 to permit loading, after which they are accelerated in accelerator 137 to rope speed.

Since all sections are slaved to the haul rope speed spacing section 147 establishes the chair spacing by bringing the chairs into contact and discharging them to the rest of the conveyor at a speed determined by the number of units to be evenly spaced along the tramway rope.

What is claimed is:

1. An aerial tramway system including a haul rope supported for movement, haul rope drive means coupled to drive said haul rope, a plurality of attachable and detachable passenger carrier units, attachment means formed to attach said units to said haul rope as it moves, detachment means formed to detach said units from said haul rope as it moves, and conveyor means receiving detached carrier units from said detachment means, decelerating said detached carrier units to a speed below said haul rope speed, advancing said detached carrier units to a spacing section, evenly spacing said detached carrier units in said spacing section for attachment to said haul rope, and accelerating said detached carrier units to said haul rope speed for attachment thereto by said attachment means, wherein the improvement in said aerial tramway system comprises:

said conveying means being provided by a plurality of side-by-side drive wheels positioned sufficiently close together so that at least one drive wheel engages said detached carrier unit over substantially the entire length of said conveyor means;

control means coupled to said conveyor means and to said haul rope drive means and slaving the speed of operation of substantially all of said drive wheels to the speed of movement of said haul rope with at least some of adjacent ones of said drive wheels being operated at different speeds to effect deceleration and acceleration of said detached carrier units on said conveyor means;

one of said drive wheels and said detached carrier units being further formed to accommodate differences in the speed of operation of adjacent drive wheels when said detached carrier unit is in driving engagement with two adjacent drive wheels operating at different speeds;

said control means controlling the speed of advancement of said detached carrier units immediately in advance of said spacing section to advance said detached carrier units at a speed above the speed of advancement in said spacing section until said detached carrier units are advanced into contact with each other in said spacing section;

said drive wheels immediately in advance of said spacing station advancing said detached carrier units into said spacing station with less driving power than the driving power of said drive wheels in said spacing station to enable said drive wheels in said spacing station to control the rate of discharge of said carrier units from said spacing station; and said control means slaving said speed of advancement of said detached carrier units in said spacing section to the speed of movement of said haul rope times a spacing factor which is directly proportional to the number of said carrier units selected to be evenly spaced along said haul rope and is inversely proportional to the maximum number of said carrier units permitted to be evenly spaced along said haul rope, and said speed of advancement in said spacing section being further divided by a speed factor based upon the minimum spacing of said carrier units possible in said spacing section.

2. The aerial tramway system as defined in claim 1 wherein, said control means is coupled to drive means immediately in advance of said spacing section, said drive means includes a plurality of independently operable eddy current motors slaved to said speed of advancement of said haul rope and connected to drive a plurality of said drive wheels.

* * * * *